US005313718A

United States Patent [19]

McMahon et al.

[11] Patent Number: 5,313,718

[45] Date of Patent: May 24, 1994

[54] ATHLETIC SHOE WITH BENDABLE TRACTION PROJECTIONS

[75] Inventors: Thomas A. McMahon, Wellesley, Mass.; Gordon A. Valiant, Lake Oswego, Oreg.

[73] Assignee: Nike, Inc., Beaverton, Oreg.

[21] Appl. No.: 3,692

[22] Filed: Jan. 13, 1993

Related U.S. Application Data

[63] Continuation of Ser. No. 639,409, Jan. 10, 1991, abandoned, which is a continuation of Ser. No. 254,839, Oct. 7, 1988, abandoned.

[51] Int. Cl.[5] ..... A43B 23/28

[52] U.S. Cl. ..... 36/59 C; 36/31; 36/114; 36/128

[58] Field of Search ..... 36/31, 59 C, 32 R, 114, 36/128, 59 A, 59 B, 59 R; D2/320, 312, 311

[56] References Cited

U.S. PATENT DOCUMENTS

| | | | |
|---|---|---|---|
| 911,479 | 2/1909 | Doughty et al. | 36/59 C |
| 3,555,697 | 1/1971 | Dassler | 36/59 C |
| 4,083,125 | 4/1978 | Benseler et al. | 36/59 C |
| 4,398,357 | 8/1983 | Batra | 36/31 X |
| 4,402,145 | 9/1983 | Dassler | 36/59 C |
| 4,449,307 | 5/1984 | Stubblefield | 36/59 C |
| 4,564,966 | 1/1986 | Chen | 36/31 X |
| 4,670,997 | 6/1987 | Beekman | 36/59 C |
| 4,689,901 | 9/1987 | Ihlenburg | 36/126 |
| 4,747,220 | 5/1988 | Autry et al. | 36/59 C |
| 4,748,750 | 6/1988 | George | 36/59 R |
| 4,769,928 | 9/1988 | Ward | 36/59 C |
| 5,203,097 | 4/1993 | Blair | 36/114 X |

FOREIGN PATENT DOCUMENTS

| | | | |
|---|---|---|---|
| 473286 | 10/1937 | United Kingdom | 36/59 C |
| 962676 | 7/1964 | United Kingdom | 36/59 C |

*Primary Examiner*—Paul T. Sewell
*Assistant Examiner*—Beth Anne C. Cicconi
*Attorney, Agent, or Firm*—Banner, Birch, McKie & Beckett

[57] ABSTRACT

There is disclosed an athletic shoe having grooves in a ground engaging surface of a sole formed concentrically about a pivot point in the ball portion and having traction projections in the form of bristles or columns embedded in the bottom of the grooves. Free ends of the traction projections protrude from the ground engaging surface whereby forces on the free ends of the traction projections perpendicular to the grooves, as when a player is accelerating, causes the projections to bend against the side walls of the grooves which thus support the projections against further bending with the free ends of the projections protruding from the outsole to provide traction. Forces on the free ends of the projections tangentially to the grooves, as when a player pivots, cause the projections to bend into or lay down in the grooves and thus offer little or no traction. The ground engaging surface of the sole is formed of a material having a low coefficient of friction so that the sole can move or pivot relatively freely once the projections have bent into the grooves.

2 Claims, 3 Drawing Sheets

ATHLETIC SHOE WITH BENDABLE TRACTION PROJECTIONS

This application is a continuation of application Ser. No. 07/639,409, filed Jan. 10, 1991 now abandoned, which in turn is a continuation of Ser. No. 07/254,839, filed Oct. 7, 1988, now abandoned.

TECHNICAL FIELD

The present invention relates to an athletic shoe and particularly to an athletic shoe adapted to resist sliding of the shoe relative to the ground in any linear translation of the shoe but which will permit, in particular, pivoting about a pivot point in the ball thereof.

BACKGROUND OF THE INVENTION

Numerous arrangements have been proposed for providing improved traction in athletic shoes in the direction longitudinally of the shoe to assist during acceleration, such as conventional cleats or spikes. These, however, also resist pivoting about the ball portion of the shoe as well as sliding movement laterally of the shoe.

Other arrangements that have been suggested, such as disclosed in U.S. Pat. No. 3,555,697 and German patent No. 30 09 381, include bristles embedded in the soles of the shoes and inclined generally in one direction so that the bristles tend to dig into the ground as force is applied to the shoe—that is, the bristles are inclined toward the rear of the sole to resist rearward movement of the shoe relative to the ground and thus to improve traction for forward movement. The amount of grip between the sole and the ground in such an arrangement depends on the number of bristles provided, as well as on the relative stiffness and length of the bristles. The stiffness of the bristles, however, affects their resistance to sliding relative to the ground in all directions. The length of the bristles affects not only their penetration into the ground but also their bending characteristics which, in turn, affects the useful life of the shoe.

U.S. Pat. No. 4,670,997 to Beekman discloses a shoe having a sole for initially facilitating rotation about an axis of rotation normal to the sole in response to the application of a moment about the axis of rotation. The sole contains flexible members radially spaced from the axis of rotation and guide means for impeding the flexing of the flexible members in response to forces which do not create moments about the axis of rotation so as to improve traction in the direction longitudinally of the shoe. The guide means allows flexing of the flexible members in response to forces which do create moments about the axis of rotation. This initially facilitates rotational motion of the foot relative to the ground. However, the shoe and foot only rotate easily until the flexible members are bent so that their lowermost surfaces are flush with the lowermost surfaces of the guide means. The lowermost surfaces of the guide means have high frictional contact with the ground and will tend to impede further rotation of the shoe and foot. Thus, only a limited range of rotational motion is provided, subjecting the wearer's foot to potentially injurious forces.

Other approaches to improve traction in shoes have included embedding elements in grooves in the soles such as the use of ropelike elements disclosed in U.S. Pat. No. 1,664,728 which are designed to support the side walls of relatively deep groves in the sole and thus to maintain the edges of the grooves in a gripping relation with the ground. Another approach of this nature as disclosed in U.S. Pat. No. 1,829,941 comprises a blade seated in a groove in the heel that protrudes from the surface of the heel to provide traction, for example, on ice. Devices of this nature are not suitable for use on surfaces such as artificial turf.

SUMMARY OF THE INVENTION

In accordance with this invention, there is provided an athletic shoe having traction projections embedded in the bottom of grooves in the outsole, the grooves being arranged concentrically about a pivot point in the ball portion and most of the grooves therefore extending laterally of the outsole. The traction projections protrude slightly from the ground engaging surface of the shoe into contact with the ground. Ground as used herein designates the playing surface on which the shoe is used, whether it be, for example, natural or artificial turf or the wood surface of a basketball court or a composition surface on a track or tennis court.

The traction projections are adapted to bend when force is exerted against their free ends. When force is exerted rearwardly endwise of the shoe as in acceleration, which is the direction transverse to most of the grooves, the traction projections bend about the point at which they are embedded in the outsole only until the protruding portions at the free ends engage the front edges of the groove. The traction projections are then supported by the edges of the grooves to place the relatively rigid free ends in engagement with the ground. At the same time, when force is exerted tangential to the grooves of the shoe as in sliding or pivoting about the ball, the shoe moves relative to the ground in a direction generally parallel to most of the grooves. The traction projections thus bend generally in the direction of the grooves and tend to lay down in the grooves and offer little or no resistance to movement of the shoe relative to the ground. The outsole or race plate includes an outsole member from which the traction projections extend, and rings which have a ground engaging surface formed of a material such as nylon or other hard plastic which will provide a low friction contact between the shoe and the ground when the traction projections are forced into the grooves. This prevents the shoe from locking the foot against rotation and possibly subjecting it to an injurious force.

The shoe in accordance with this invention may be adapted for use, for example, on a basketball court and the traction projections can be formed as columns of high-friction material such as rubber. The shoe may also be adapted for use on artificial turf wherein the protruding free ends of the traction projections tend to penetrate the surface and to provide traction. The traction projections can be formed as bundles of bristles or columns of high-friction material when the shoe is to be used on artificial turf.

A more complete appreciation of the invention and many of the attendant advantages thereof will be readily obtained as the invention becomes better understood by reference to the following detailed description when considered in connection with the accompanying drawings.

DETAILED DESCRIPTION

Figure 1:
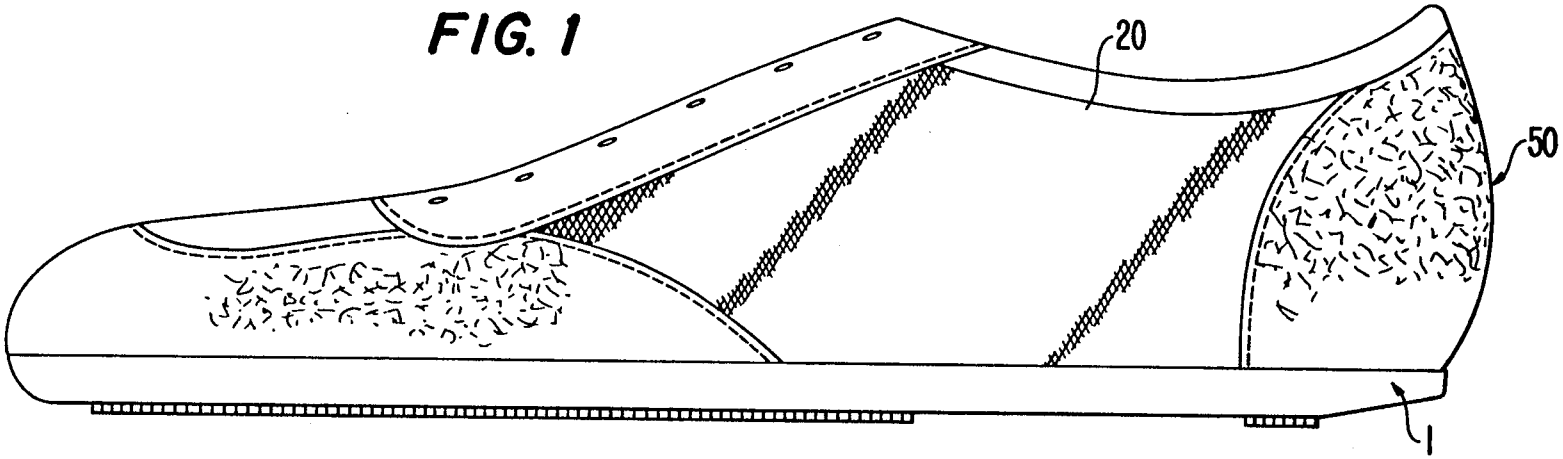
FIG. 1 is a side elevational view of an athletic shoe in accordance with the present invention.
Figure 2:
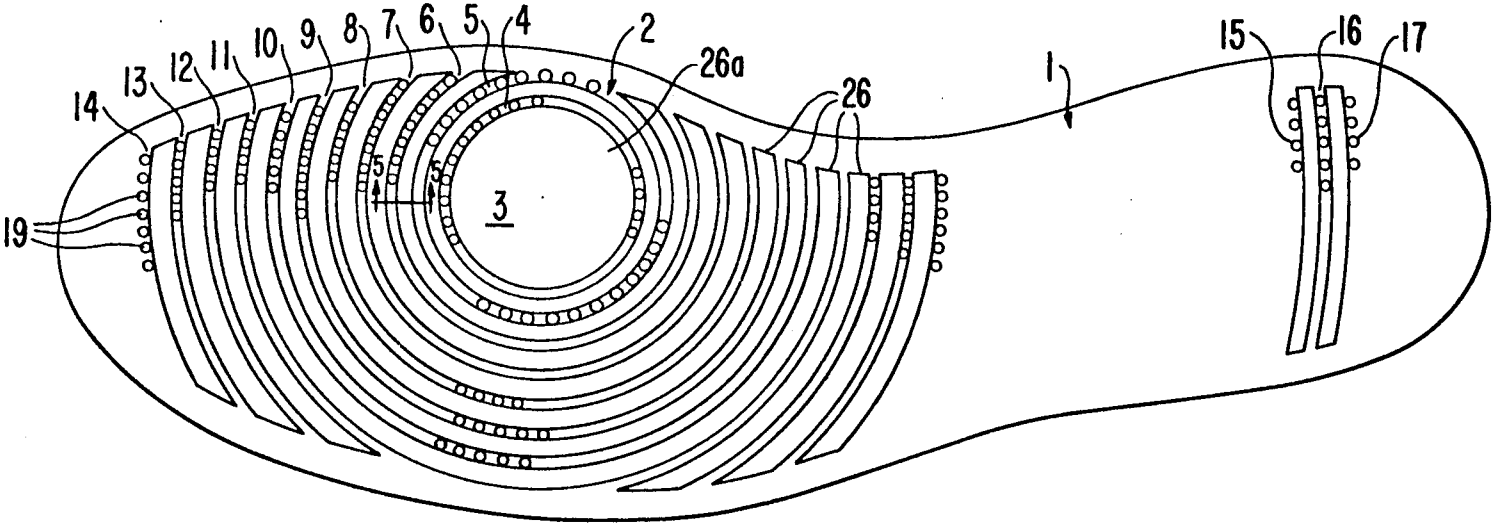
FIG. 2 is a plan view of the bottom of the athletic shoe of FIG. 1.

Referring to the drawings wherein like numerals indicate like elements, there is shown in FIG. 1 an athletic shoe designated generally as 50. A race plate or outsole 1 is attached to upper 20 of athletic shoe 50. Outsole 1 includes outsole member 1*a* which is provided with a plurality of traction projections 19. Traction projections 19 are arranged in concentric circles. Outsole 1 further includes rings 26 of a low friction material such as nylon or teflon which are secured between adjacent circles of traction projections 19 to the bottom surface of outsole member 1*a*. Materials with a kinetic coefficient of friction of 0.2 to 0.4 with respect to the type ground surface on which the shoe is to be used would be suitable. The bottom surfaces of rings 26 represent the ground engaging surface of the shoe. It should be noted that "rings" and "circles" as used herein broadly refers to either (1) complete rings and circles or (2) segments thereof where the ring or circle diameter is greater than the width of outsole 1. A disk 26*a* of low friction material is disposed within the region inside the innermost ring of traction projections 19. As shown in FIG. 2, disk 26*a* and rings 26 are arranged concentrically about a pivot point 3 in the ball portion so as to define a plurality of concentric grooves 2 within which traction projections 19 are disposed. Grooves 2 include concentric circular grooves 4 and 5 and segments of grooves 6–14 which have a diameter greater than the width of outsole 1 and therefore define incomplete or broken circles. Additionally groove segments 15, 16, and 17, similarly defined by rings 26 and traction projections 19 may be provided in the heel portion of outsole 1. It should be emphasized that the rings should have relatively low friction on the surface for which the athletic shoe is designed for use.

Figure 3:
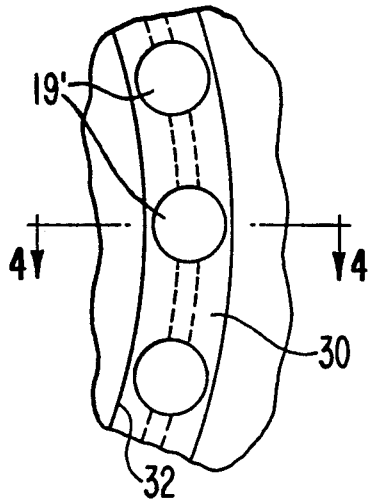
FIG. 3 is an enlarged view of the bottom of the athletic shoe of FIG. 1 depicting a groove and the embedded traction projections.
Figure 4:
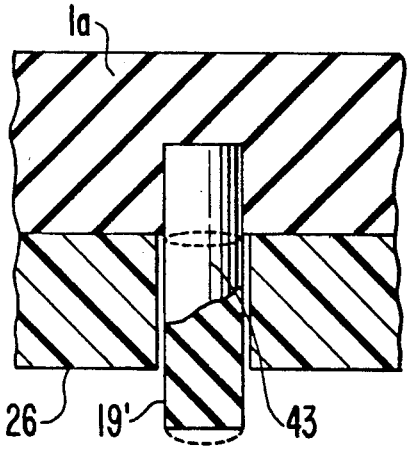
FIG. 4 is a sectional view along line 4—4 of FIG. 3.

Traction projections 19 are distributed uniformly at a relatively close spacing along each groove 2. In the illustrated embodiment, traction projections 19 are formed as columns or cleats 19′ of rubber or other high friction material. As suggested by the dashed curve in FIG. 4, the columns may be formed with rounded ends. Columns 19′ are preferably molded into outsole member 1*a* although the invention is not limited by the manner in which columns 19′ are secured to outsole member 1*a*. Columns 19′ extend perpendicular to the plane of the ground engaging surface of outsole 1, parallel to and normally spaced from the opposed parallel side walls 30, 32 of the grooves 2 as shown in FIGS. 3 and 4. The length of columns 19′ is such that the free ends thereof protrude slightly from the ground engaging surface of outsole 1.

Figure 5:
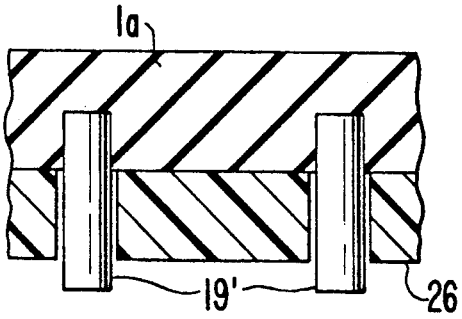
FIG. 5 is a fragmentary sectional view along line 5—5 of FIG. 2.

While columns 19′ are relatively stiff, they are also adapted to bend from the ends embedded in outsole 1 under forces exerted at their free ends. The normal posture of columns 19′ is as shown in FIGS. 4 and 5, that is, extending perpendicular to the ground engaging surface of outsole 1 and spaced from side walls 30, 32 of grooves 2.

Figure 6:
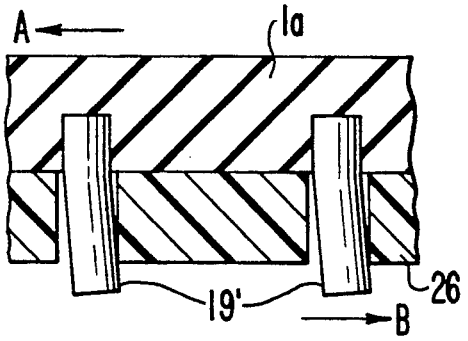
FIG. 6 is a fragmentary sectional view similar to FIG. 5 showing the bristles in the outsole stressed in the direction perpendicular of the grooves.

As shown in FIG. 6, when stress is applied to the free ends of columns 19′ in a direction perpendicular to grooves 2—for example when outsole 1 is moved in the direction of arrow A in FIG. 6, the free ends of columns 19′ which are in contact with the ground are stressed in the direction of the arrow B, and bend in the direction of the arrow B until they engage one of the side walls of the grooves 2, and are supported by the side wall. Columns 19′ are thus maintained generally upright with their free ends protruding and in engagement with the ground to provide traction.

Figure 7:
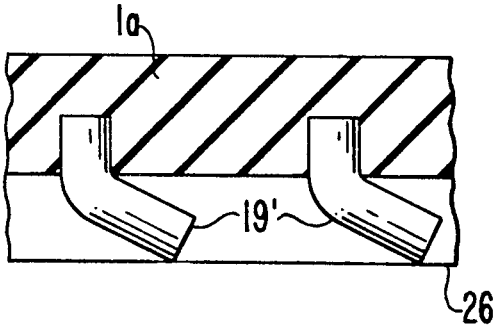
FIG. 7 is a fragmentary sectional view longitudinally of a groove in the outsole of the athletic shoe shown in FIG. 1 showing the traction projections stressed in the direction tangential to the grooves.

As shown in FIG. 7, when stress is applied to the free ends of columns 19′ in a direction tangential to the grooves, their free ends bend into grooves 2 and will continue to bend until they are disposed entirely in the grooves. Thus, the free ends of columns 19′ offer little or no resistance to the movement of outsole 1 relative to the ground. Since rings 26 are formed of low friction material, the shoe is adapted to slide relatively freely with respect to the ground when such tangential stress is applied.

Since the grooves are disposed concentric about pivot point 3 in the ball portion of the outsole 1, most of the grooves 6–14 are generally transverse to the center line of the shoe, which is the line extending from the toe portion, through the ball portion to the heel portion. Grooves 4 and 5 include substantial portions that are transverse to the center line. Grooves 15, 16 and 17 in the heel portion of the outsole 1 also extend generally transversely of the center line of the shoe.

Accordingly, when a player exerts a shearing force on the shoe as in accelerating and the force is exerted longitudinally of outsole 1, most of columns 19′ in grooves 6–14, as well as most columns in grooves 15, 16 and 17, and a substantial number of those in the circular grooves 4 and 5, all bend into engagement with the adjacent walls of the grooves 2 as shown in FIG. 6 and are then supported by the walls of the grooves. Further bending of columns 19′ is thus prevented and the free ends of the columns protrude from the ground engaging surface of the outsole 1 to provide traction. Grooves 4 and 5, and to a lesser extent grooves 6–14, also provide traction in a medio-lateral direction radially of pivot point 3 as for instance when a player changes direction. However, when a player pivots on the ball portion of the shoe about pivot point 3, all of the columns in the grooves 4–16 are moved in a direction longitudinally of their respective grooves and, as shown in FIG. 7, are bent into the grooves and offer little or no resistance to the movement. Thus, during this pivoting action, low friction rings 26 are in contact with the ground and pivoting is facilitated such that the player's foot will not be locked in place. This reduces the potential for serious injury.

Shoes with traction projections made of rubber or other high friction materials could be used on wood floors, as, for example, a basketball court, as well as on artificial playing surfaces which simulate grass.

In practice, a shoe constructed in accordance with the present invention should meet several requirements. The translational friction force of a shoe including the traction projections should be at least two times the translational friction force of the same shoe without the traction projections, i.e. with only the low friction rings. Also, the translational coefficient of friction provided by the cleats should be greater than 1.0, noting that translational friction varies with load (i.e., weight of person wearing the shoe) and velocity, and that the specified translational coefficient of friction is for an average adult moving at average walking to running speeds. In addition, the resistance of the shoe to a tangential force should not be substantially affected by the traction projections. One manner of determining this resistance is to apply a tangential force to a shoe subjected to a load slightly greater than the average body weight. The peak frictional moment during rotation of the shoe is measured. The peak moment is indicative of the resistance of the shoe to pivoting motion. The peak moment of a shoe including the traction projections should not be substantially greater than the peak moment of the same shoe without the traction projections.

Figure 9:
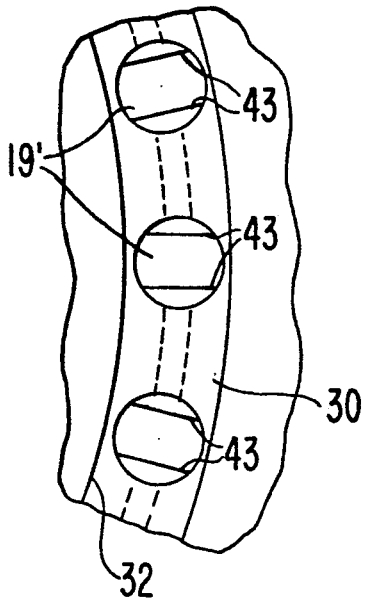
FIG. 9 is a view similar to FIG. 3, partially in section, illustrating cut-out sections in the traction projections.

The dimensions and characteristics of the traction projections play an important role in both translational and rotational friction. The traction projections must be a sufficient overall length to facilitate bending during pivoting motion and also must project from the ground engaging surface to generate sufficient translational friction. Increasing the diameter of traction projections increases translational friction, but inhibits bending. The overall length, projecting length and diameter of the traction projections thus, must be coordinated to obtain the desired frictional objections. As shown in FIGS. 4 and 9, notches 43 may be provided in the traction projections as an alternative for facilitating bending. Two notches are provided in each traction projection, each notch extending in a direction substantially perpendicular to the tangent of the groove at that point, so as to facilitate flexing in both pivoting directions while bending toward the sidewalls of the groove is still inhibited.

Figure 8:
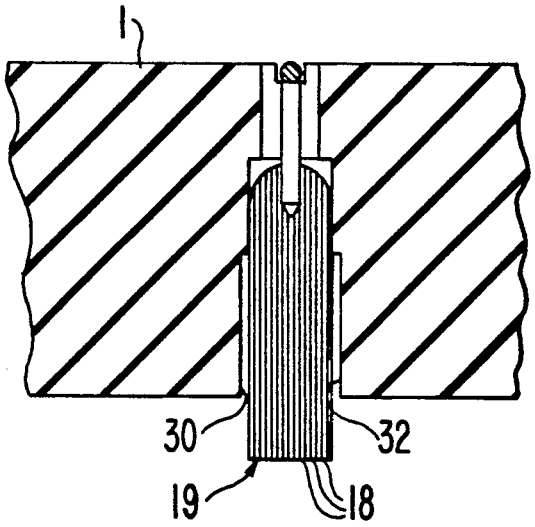
FIG. 8 is a fragmentary sectional view similar to FIG. 4 illustrating a further embodiment of the present invention.

When the shoe is adapted for use on artificial turf, traction projections 19 may be formed either as column 19 or as bundles of bristles 18 as shown in FIG. 8 which are made from relatively stiff cylindrical elements formed for example of nylon or polypropylene. Bristles 18 comprise bundles of filaments that are drawn into U-shaped circular holes formed in the bottom of the grooves—the holes being for example about 3 mm in diameter (slightly less than the width of the grooves) and about 2 mm deep, and spaced apart about 4 mm center to center. The bundles of filaments are drawn into the holes and held therein by wire 24 of, for example, stainless steel that is, threaded upwardly and then downwardly through a pilot hole formed through the sole in the center of the filament retaining hole to form a loop that encircles the mid-point of the bundles of filaments. The ends of wire 24 are secured in the soles, for example, by looping them through a pair of pilot holes and tying them off. The ground engaging surface of the sole may include a clearance groove interconnecting the pilot holes in which the lead of the wire between the holes is seated. The number and size of the bristles in the bundle can vary but typically may comprise for example, twenty-five strands of nylon approximately 0.3 mm in diameter, thus producing a tuft of fifty strands, the bristles extending from the sole a distance of about 3 or 4 mm or so. In this embodiment the outsole or race plate is molded of a material such as nylon or other hard plastic which has a relatively low frictional resistance on artificial turf.

It is to be understood that the invention is not limited to the illustrative described and shown herein, which are deemed to be merely illustrative of modes of carrying out the invention, and which are susceptible of modification of form size, arrangement of parts and details of operation. The invention rather is intended to encompass all such modifications which are within its spirit and scope as defined by the claims.

We claim:

1. A sole for an athletic shoe comprising:

an outsole member having a plurality of traction projections extending outwardly therefrom, said plurality of traction projections including traction projections arranged concentrically about a pivot point located in the ball portion of said outsole member;

a plurality of concentric rings secured to said outsole member to define a ground engaging surface, said concentric rings being oriented relative to said concentric traction projections such that said concentric traction projections are movable between a first position extending outward of said ground engaging surface to provide traction against a ground surface material when said sole is moved in generally linear translational motion and a second position inward of said ground engaging surface and substantially out of contact with the ground surface material to minimize traction when said sole is moved about in generally pivoting motion; and wherein said traction projections include notches for facilitating movement of said traction projections to the second position inward of said ground engaging surface, said notches formed in an outer cylindrical surface of said columns and extending in a direction substantially perpendicular to a tangent of a groove at positions of respective traction projections.

2. The sole in accordance with claim 1 wherein each traction projection includes two notches.

* * * * *